United States Patent [19]

Stobb

[11] Patent Number: 4,540,168

[45] Date of Patent: Sep. 10, 1985

[54] METHOD AND APPARATUS FOR REMOVING SHEETS FROM A STACK

[75] Inventor: Walter J. Stobb, Pittstown, N.J.

[73] Assignee: Stobb, Inc., Clinton, N.J.

[21] Appl. No.: 506,525

[22] Filed: Jun. 22, 1983

[51] Int. Cl.[3] ..... B65H 3/08

[52] U.S. Cl. ..... 271/101; 271/107

[58] Field of Search ..... 271/90, 91, 93, 94, 271/99, 100, 101, 106, 107, 171, 113

[56] References Cited

U.S. PATENT DOCUMENTS

| | | | |
|---|---|---|---|
| 1,794,198 | 2/1931 | Murray | 271/101 |
| 2,799,497 | 7/1957 | Novick | 271/101 |
| 2,817,520 | 12/1957 | Gentry | 271/101 |
| 3,172,655 | 3/1965 | Lenk | 271/101 |
| 3,650,525 | 3/1972 | Hageman et al. | 271/113 |
| 3,702,187 | 11/1972 | Hageman et al. | 271/101 |
| 3,768,804 | 10/1973 | Swanson | 271/101 |
| 4,050,692 | 9/1977 | Marass | 271/91 |

*Primary Examiner*—Bruce H. Stoner, Jr.
*Assistant Examiner*—John A. Carroll
*Attorney, Agent, or Firm*—Arthur J. Hansmann

[57] ABSTRACT

A method and apparatus for singly removing the bottom one of a sheet from a stack of sheets, and utilizing counter rotating discs or plates which sweep the bottom sheet toward its opposite edges and thus create a flat and smooth bottom surface for contact by suction cups to remove the sheet from the stack. The plates are adjustable relative to the widths of the sheets, to thereby accommodate various widths of sheets. An intermediate or central portion of the lower sheet of the stack is made smooth and flat for contact by a suction cup which can therefore remove the sheets at high speeds.

6 Claims, 3 Drawing Figures

FIG. 1
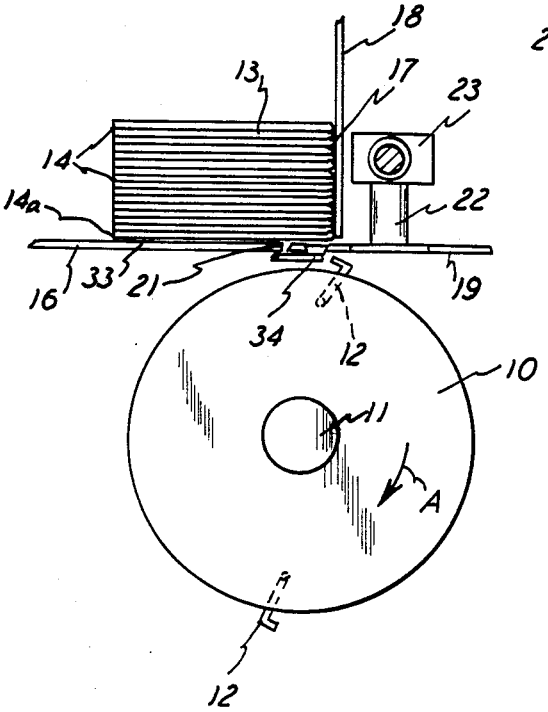
FIG. 2
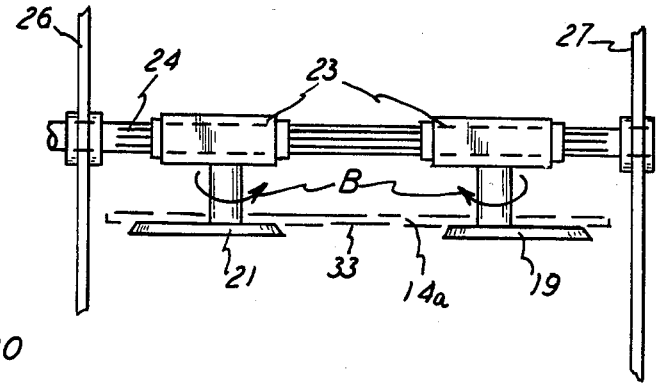
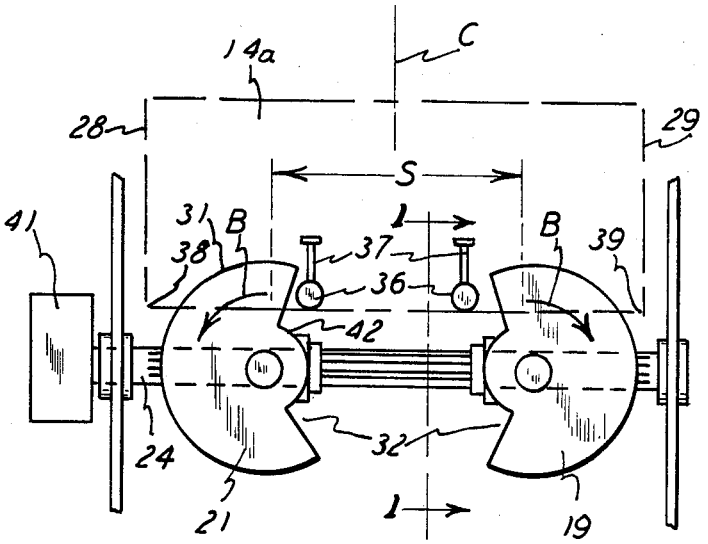
FIG. 3

METHOD AND APPARATUS FOR REMOVING SHEETS FROM A STACK

This invention relates to a method and apparatus for singly removing sheets from the bottom of a stack of sheets, and, more particularly, it involves the use of a vacuum pick-up device for gripping and moving the sheets.

BACKGROUND OF THE INVENTION

The prior art has utilized vacuum pick-up devices for moving sheets from stacked positions, and it has also already utilized rotating plates or the like which move on the bottom surface of the lower sheet in the stack to uprightly support a portion of the stack and to ultimately be clear of the portion of the stack so that the vacuum pick-up device can take the sheet from the stack. Such prior art pick-up devices are commonly known by anyone skilled in the art and they utilize a rotating plate which sweeps across the bottom of the stack and has a cut-out therein for the location and operation of the vacuum pick-up device which alternates with the plate for contacting the sheet.

The present invention improves upon the prior art in that it utilizes two flat plates which move across the bottom surface of the lower sheet in the stack and sweep the lower sheet in the nature of urging it to its opposite sides for creating a smooth and flat plane at its portion intermediate its opposite sides, so that the vacuum pick-up device can securely engage the sheet and remove it from the bottom of the stack.

Further, the present invention provides for the two plates to be oppositely rotating plates which sweep the lower sheet into a smooth and flat plane and which then clear the sheet so that two vacuum pick-up devices can operate on the smoothed portion of the sheet for removing the sheet. Still further, the present invention provides for an adjustment mounting for the rotating plates so that they can be adjustably moved toward and away from each other to accommodate sheets of various widths, and thereby adequately condition the lower sheet into the smooth and flat plane mentioned.

BRIEF DESCRIPTION OF THE DRAWINGS

FIG. 1 is a side elevational view of a preferred embodiment of this invention, and the view is taken along the section line 1—1 of FIG. 3.

FIG. 2 is a front elevational view of FIG. 1.

FIG. 3 is a bottom plan view of FIG. 2, and with a drive mechanism added thereto.

DETAILED DESCRIPTION OF THE PREFERRED METHOD AND APPARATUS

The drawings show apparatus for carrying out this invention, and, the description of the drawings will also involve describing the method. Both the method and apparatus involve creating a smooth surface on the bottom sheet in the stack so that the vacuum pick up can securely and readily engage the bottom sheet and remove it from the stack. In this manner, the sheets can be removed at a speed which is much in excess of the speeds achieved by apparatus currently in use.

A gripper cylinder 10 is mounted on a shaft 11 and rotates in the direction of the arrow designated A. Conventional grippers 12 are mounted on the cylinder 10 and operate to open and close and thereby carry the sheet around the cylinder to deposit it on a conveyor which is unshown, but which would be collecting the sheets in a conventional manner. A stack 13 of sheets 14 is shown to have a horizontal orientation with the sheets basically resting on a stack support 16 which is at least generally horizontal, as shown in FIG. 1. It will be noticed that the support 16 does not extend completely to the folded side 17 of the stack 13 where a fixed upright support 18 is also located. Thus, the lower portion of the stack 13 adjacent the folded upright plane and side 17 is unsupported or exposed downwardly where the apparatus of this invention is operative.

In that regard, two counter rotating plates 19 and 21 are disposed adjacent the stack 13 and in a horizontal plane substantially the same as that of the support 16 to terminate adjacent the edge 21 of the support 16. The plates 19 and 21 are suitably rotatably mounted on shafts 22 which extend off respective left and right hand gear boxes 23, as shown. In turn, the boxes 23 are supported on a drive shaft 24 which is supported in side frame members 26 and 27. Thus the plates 19 and 21 extend underneath the stack 13 and intersect the stack edge plane 17 and provide upward support for the otherwise unsupported portion of the stack 13. That is, the lower or bottom sheet **14*a* rests downwardly on the support 16 as well as on the plates 19 and 21, at certain times. The plates 19 and 21 are shown spaced inwardly from the opposite sides 28 and 29 of the sheets 14 in the stack 13, as seen in FIGS. 2 and 3. That is, the plates 19 and 21 are shown to be circular in a substantial portion thereof in that they have an outer circular edge 31 and they also have a cut-out portion designated 32 which is away from the sheet 14*a* when the plates 19 and 21 are in a certain rotated position. Therefore, at certain times the plates 19 and 21 are in contact with the lower surface 33 of the bottom sheet 14*a*, and sometimes the plates 19 and 21 are completely clear of the bottom sheet 14*a*. The plates 19 and 21 slide over portions of the bottom surface 33 and also move completely clear of the portion of the lower surface 33**.

When the plates 19 and 21 are clear of the lower sheet **14*a*, then a conventional tupe of vacuum pick-up device 34 can engage the bottom sheet 14*a* and lower it from the stack 13 and place it to within the reach of the cylinder gripper 12 so that the bottom sheet 14*a* can be removed from the stack, and the process is then repeated for the next bottom sheet in the stack 13. The pick-up device 34 is shown in FIG. 3 to be in two suction cups 36 movably mounted on suitable arms 37 which permit the cups 36 to pivot up and down in pulling the bottom sheet into the grippers 12, all in a conventional arrangement with respect to a single vacuum type of suction device. The device 34 is shown to be operative on that horizontal plane established by the support 16 and the plates 19 and 21**, as previously described.

The plates 19 and 21, and also the suction cups 36, are both spaced apart along the front edge 17 of the sheets in the stack 13, and they are also spaced inwardly from the two front corners 38 and 39 of the sheets 14 in the stack 13. However, the plates 19 and 21 intersect the front edge 17, as clearly seen in FIGS. 1 and 3, and the suction devices 36 are adjacent the front edge 17.

FIGS. 2 and 3 show that the two counter rotating plates 19 and 21 rotate in the direction of the arrows designated B, and that is the opposite direction of rotation for the two plates 19 and 21. Also, the suction cups 36 are disposed inwardly, relative to the axes of rotation of the plates 19 and 21, as seen in FIG. 3. With that arrangement, the two plates 19 and 21 engage the lower surface 33 and urge it outwardly toward its opposite sides 28 and 29 and thereby create a smooth flat plane in at least the area of the lower surface as designated by the dimension lines shown by the dimension designated S. That area of the lower surface 33 is thus created smooth and flat, and it is beyond the span and spacing of the suction cups 36, so the suction cups 36 can operate on that smooth and flat lower surface 33 and thereby quickly and securely engage the lower sheet 14*a* and pull it from the bottom of the stack 13. Of course the suction cup device 34 is operative to pivot up into contact with the lower surface 33 when the discs have rotated in unison to present their respective openings 32 toward the stack 13 and thereby provide the clearance for the suction cups 36, as shown in the position in FIG. 3. Further, it will be seen that the discs 19 and 21 are spaced within the sheet opposite sides 28 and 29, and thus they sweep toward the sheet corners 38 and 39 to flatten the center portion of the sheet, as designated S, for the optimum contact of the sheet lower surface 33 by the suction cups 36.

The plates 19 and 21 are rotated in unison, and they are driven from the gear boxes 23 which in turn are operated off what is shown as a spline shaft 24. Thus, in a conventional arrangement, the gear boxes 23 can slide axially of the shaft 24 and thereby be adjustable to the left and right, as viewed in FIGS. 2 and 3. In that manner, the plates 19 and 21 are adjustable with respect to the widths of the sheets 14 in the stack, and thereby sheets of varying widths can be accommodated in this method and apparatus, also that the plates 19 and 21 will always be spaced inwardly on the sheets 14 and thereby sweep the sheets to both sides of their center plane designated C and thereby create the smooth and flat surface for the operation of the suction cups 36 at the high speeds desired.

A powered drive 41 is shown connected with the shaft 24 for rotating the shaft and thereby operating the left and right gear boxes 23 in the manner described. Of course the plates 19 and 21 have their foremost extents 31 intersecting the stack forward edge 17, and thus also intersecting the vertical plane of the vertical stack stop 18, but the plates 19 and 21 also have edges 42 which extend short of the plate 18, and thus completely free of the sheets in the stack 13, so that the sheets can be pulled down below the horizontal plane of the side-by-side plates 19 and 21, and thus onto the gripper cylinder 10.

What is claimed is:

1. Apparatus for singly removing sheets from the bottom of a stack of sheets having a front side and two corners at the limits of said front side and wherein the sheets are in a horizontal orientation and the sheet on the bottom has a lower surface and two corners, comprising two spaced-apart flat plates rotatably mounted to be adjacent said stack of sheets and being rotatable in opposite directions in simultaneous contact with said lower surface for upwardly supporting said stack of sheets and for forming said lower surface into a smooth flat plane and to subsequently rotate to be away from a portion of said lower surface, said two plates being located to have their rotation axes disposed respectively inwardly relative to said two corners and with said plates being rotatable only toward said corners when in contact with said lower surface for urging said two corners away from each other in forming said lower surface into the smooth flat plane, powered means connected with said plates for rotating said plates, and a vacuum pick-up device mounted adjacent said plates and movable upwardly to said plane and thereby be in contact with and operable on said portion of said lower surface when said plates are still in contact with said lower surface but away from said portion, and thereafter moving said plates away from said lower surface for removing said bottom sheet from said stack of sheets by said vacuum pick-up device.

2. The apparatus of singly removing sheets from the bottom of a stack of sheets wherein the sheets are in a horizontal orientation and the sheet on the bottom has a lower surface and two corners, as claimed in claim 1, including an adjustable mounting for said plates, and said plates being mounted on said adjustable mounting for adjustably altering the spacing between said plates and thereby accomodate stacks of sheets of various widths.

3. The apparatus of singly removing sheets from the bottom of a stack of sheets wherein the sheets are in a horizontal orientation and the sheet on the bottom has a lower surface and two corners, as claimed in claim 1, including the respective axes of rotation of said plates being offset from said stack beyond the front side of the stack.

4. A method of singly removing sheets from the bottom of a stack of sheets having an uprightly disposed front side and two corners at the limit of said front side, comprising the steps of arranging said stack of sheets in a horizontal orientation with the bottom one of the sheets having a lower surface on the horizontal underneath side thereof, simultaneously rotating two spaced apart flat plates in sliding contact with said lower surface and only in opposite directions away from each other on said lower surface and only adjacent said front side and only respectively toward said corners to urge said lower surface into a flat plane, said plates being respectively rotated toward a respective one of said two corners when in contact with said lower surface, said plates being moved along the contacted lower surface to leave a portion thereof free of said plates, and applying a vacuum pick up to said portion of said lower surface at the location adjacent said front said while said lower surface is still being contacted by said plates and after said plates have moved a distance only away from each other along said lower surface, and thereafter moving said plates away from said lower surface for removing said bottom one of sheets from the stack of sheets by said vacuum pick-up device.

5. The method of singly removing sheets from the bottom of a stack of sheets having an uprightly disposed front side and two corners at the limit of said front side, as claimed in claim 4, including the step of rotating said plates about respective axes offset from said stack beyond the side of said front side.

6. The method of singly removing sheets from the bottom of a stack of sheets, as claimed in claim 4, including applying two of said vacuum pick ups to said lower surface at spaced apart locations thereon.

* * * * *